US005655179A

United States Patent [19]

Ueda et al.

[11] Patent Number: 5,655,179

[45] Date of Patent: Aug. 5, 1997

[54] DEVELOPER REPLENISHING APPARATUS HAVING ENGAGING MECHANISMS FOR PREVENTING TONER SCATTER DURING TONER REPLENISHMENT

[75] Inventors: Hiroyuki Ueda; Kenichi Tanabe, both of Osaka, Japan

[73] Assignee: Mita Industrial Co., Ltd., Osaka, Japan

[21] Appl. No.: 652,982

[22] Filed: May 24, 1996

[30] Foreign Application Priority Data

Jun. 15, 1995 [JP] Japan ..... 7-148468
Dec. 27, 1995 [JP] Japan ..... 7-340338

[51] Int. Cl.[6] ..... G03G 15/08

[52] U.S. Cl. ..... 399/105; 141/364; 141/386; 222/DIG. 1; 399/262

[58] Field of Search ..... 355/260, 215; 222/DIG. 1; 141/364, 366, 346, 383, 386

[56] References Cited

U.S. PATENT DOCUMENTS 5,040,024 8/1991 Fukuda et al. ..... 355/260

5,481,344 1/1996 Yasuda et al. ..... 355/260

*Primary Examiner*—Arthur T. Grimley
*Assistant Examiner*—Sophia S. Chen
*Attorney, Agent, or Firm*—Beveridge, DeGrandi, Weilacher & Young, LLP

[57] ABSTRACT

A developer replenishing apparatus includes a developer housing, a replenishing developer container accommodating a developer, an adapter to be mounted detachably on the replenishing developer container, and a tentative cap to be mounted detachably on an outlet portion of the adapter. The tentative cap has a top panel wall and a skirt wall formed so as to extend downwardly from the outer peripheral edge of the top panel wall. The skirt wall is composed of opposite side walls and a rear wall, and has an opening at its front part. A shielding plate covering the upper part of the developer housing is provided with a cap fitting portion and an adapter guide portion. On the shielding plate is mounted a sealing device adapted to cover the adapter guide portion and be caused to elastically open according to the movement of the adapter.

9 Claims, 11 Drawing Sheets

DEVELOPER REPLENISHING APPARATUS HAVING ENGAGING MECHANISMS FOR PREVENTING TONER SCATTER DURING TONER REPLENISHMENT

FIELD OF THE INVENTION

This invention relates to a developer replenishing apparatus for replenishing a developing device, mounted on an image forming machine such as an electrostatic copying apparatus or a laser printer, with a toner as a developer.

DESCRIPTION OF THE PRIOR ART

An image forming machine is generally adapted to replenish a toner which is consumed as an image is formed. When the toner accommodated in a developer housing for accommodating a developer to be fed to a developing device has been used up, the cover of the developer housing is opened, a cap on a replenishing developer container accommodating a toner for replenishment is removed, and the toner accommodated in the replenishing developer container is replenished into the developer housing. If the cover of the developer housing is open during the toner replenishment, the toner put into the developer housing from the replenishing developer container flies up and scatters to the surroundings. Proposals for preventing the toner scatter during the toner replenishment are disclosed, for example, in Japanese Laid-Open Patent Publication Nos. Sho 60-91371 and 61-55672. The technology disclosed in Japanese Laid-Open Patent Publication No. Sho 60-91371 involves attaching a fastener as a shielding member to an opening portion of the developer housing, causing the fastener to hold a moving plate provided with an inlet port to be fitted with a mouth and neck portion of the replenishing developer container accommodating a toner for replenishment, and inserting the mouth and neck portion of the replenishing developer container into the inlet port provided in the moving plate to supply the toner into the developer housing while moving the replenishing developer container. The technique disclosed in Japanese Laid-Open Patent Publication No. Sho 61-55672 comprises mounting two sealing members comprising an elastic material such as rubber on the opening portion of the developer housing, and inserting the mouth and neck portion of the replenishing developer container into a joint of the two sealing members to supply the toner into the developer housing while moving the replenishing developer container.

The technologies described in those publications still pose the problem that when the mouth and neck portion of the replenishing developer container is inserted into the inlet port or the joint of the sealing members, the toner overflows the outlet port of the replenishing developer container, scattering over the sealing members. Moreover, the problem arises that when the mouth and neck portion of the replenishing developer container is pulled out of the inlet port or the joint of the sealing members at the completion of toner replenishment, the remaining toner, if any, in the replenishing developer container floods the fastener or the sealing members.

SUMMARY OF THE INVENTION

The object of the present invention is to provide a developer replenishing apparatus and a tentative cap for developer replenishment, adapted to prevent an overflow of the toner at the time of setting and withdrawal of a replenishing developer container, in which a tentative cap is mounted on an outlet portion of a replenishing developer container; the tentative cap is fitted at a predetermined position of a developer housing and the replenishing developer container is moved in a predetermined direction, whereby the tentative cap can be released; and the tentative cap is mounted again on the outlet portion of the replenishing developer container at the completion of toner replenishment, whereafter the replenishing developer container is taken out.

According to a first aspect of the present invention for attaining the above-described object, there is provided a developer replenishing apparatus comprising a developer housing for accommodating a developer to be fed to a developing device, a replenishing developer container accommodating a developer for replenishment into the developer housing, an adapter having a mounting portion to be mounted detachably on a mouth and neck portion of the replenishing developer container and an outlet portion formed as an attachment to the mounting portion and having an outlet port for releasing the developer, and a tentative cap mounted detachably on the outlet portion of the adapter and closing the outlet port, wherein the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, the developer housing has a shielding plate covering its upper part, the shielding plate is provided with a guide hole including a cap fitting portion formed at an end portion of the shielding plate and being to be fitted with the tentative cap, and including an adapter guide portion formed so as to communicate with the cap fitting portion and having a width dimension smaller than the external surface width of the tentative cap and larger than the external surface width of the outlet portion of the adapter, and a sealing means adapted to cover the adapter guide portion of the guide hole and be caused to elastically open by the adapter moving along the adapter guide portion is mounted on the upper surface of the shielding plate.

According to a second aspect of the present invention for attaining the above-described object, there is provided a developer replenishing apparatus comprising a developer housing for accommodating a developer to be fed to a developing device, a replenishing developer container accommodating a developer for replenishment into the developer housing, an adapter having a mounting portion to be mounted detachably on a mouth and neck portion of the replenishing developer container and an outlet portion formed as an attachment to the mounting portion and having an outlet port for releasing the developer, and a tentative cap mounted detachably on the outlet portion of the adapter and closing the outlet port, wherein the developer housing has a shielding plate covering its upper part, the shielding plate is provided with a guide hole including a cap fitting portion formed at an end portion of the shielding plate and being to be fitted with the tentative cap, and including an adapter guide portion formed so as to communicate with the cap fitting portion and having a width dimension which is smaller than the width of the cap fitting portion and through which the outlet portion of the adapter can be inserted, the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, and engaging means for engaging the cap fitting portion at predetermined positions, with the tentative cap being fitted into the cap fitting portion, are provided on the opposite side walls of the skirt wall, and the engaging means comprise engaging protrusions provided on the opposite side walls of the skirt wall and engaging the upper surface of the shielding plate defining the cap fitting portion, and flexible engaging tongue pieces connected at an end to the top panel wall side of the opposite side walls of the skirt wall and extending downwardly along the skirt wall, and the engaging tongue pieces are provided with engaging claws engaging the lower surface of the shielding plate defining the cap fitting portion.

According to a third aspect of the present invention, there is provided a tentative cap for replenishment of a developer, which is mounted detachably on an outlet portion of an adapter mounted detachably on a mouth and neck portion of a replenishing developer container accommodating a developer for replenishment into a developer housing, wherein the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, and engaging means for engaging a cap fitting portion at predetermined positions, with the tentative cap being fitted into the cap fitting portion, are provided on the opposite side walls of the skirt wall, the cap fitting portion being formed at an end portion of the shielding plate covering the upper part of the developer housing, and the engaging means comprise engaging protrusions provided on the opposite side walls of the skirt wall and engaging the upper surface of the shielding plate defining the cap fitting portion, and flexible engaging tongue pieces connected at an end to the top panel wall side of the opposite side walls of the skirt wall and extending downwardly along the skirt wall, and the engaging tongue pieces are provided with engaging claws engaging the lower surface of the shielding plate defining the cap fitting portion.

Other objects and characteristics of the present invention will become apparent from the following description.

DETAILED DESCRIPTION OF THE PREFERRED EMBODIMENT

The present invention will be described in more detail by reference to the accompanying drawings illustrating preferred embodiments of a developer replenishing apparatus constructed in accordance with the present invention, and a tentative cap for replenishment of a developer.

Figure 1:
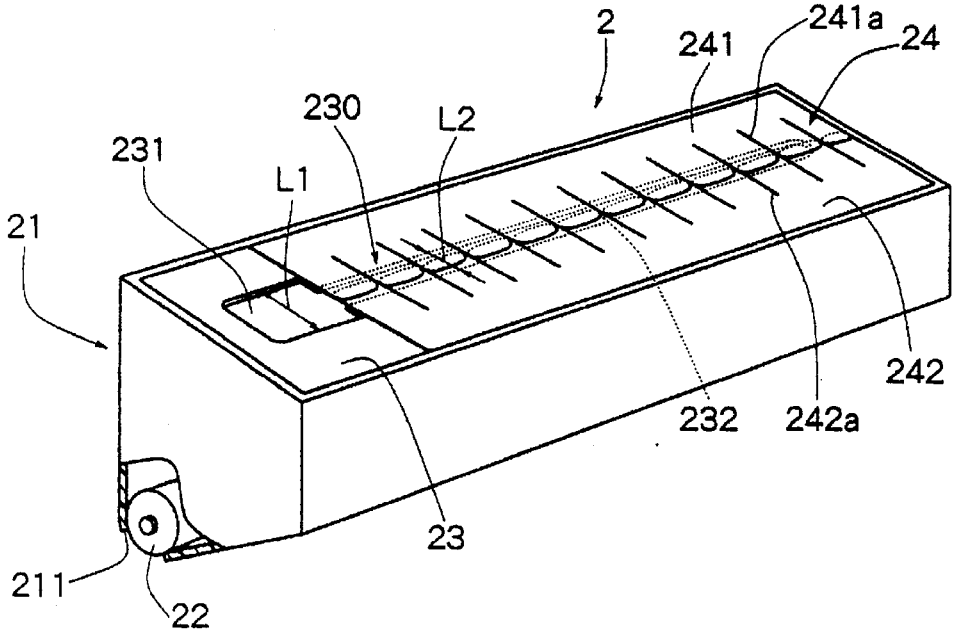
FIG. 1 is a perspective view, partly broken away, showing an embodiment of a developer housing constituting a developer replenishing apparatus according to the present invention.
Figure 2:
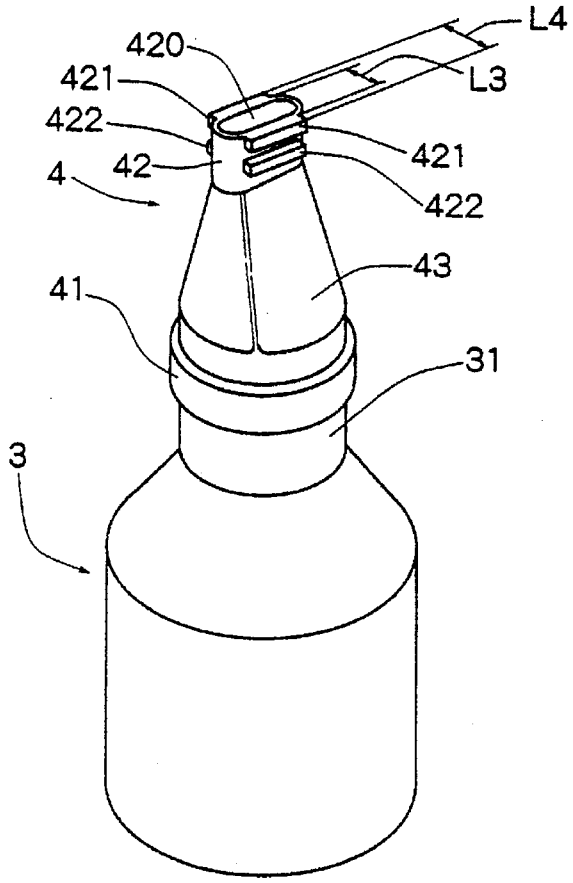
FIG. 2 is a perspective view showing an embodiment of a replenishing developer container constituting the developer replenishing apparatus of the present invention, and an adapter mounted on the replenishing developer container.
Figure 3:
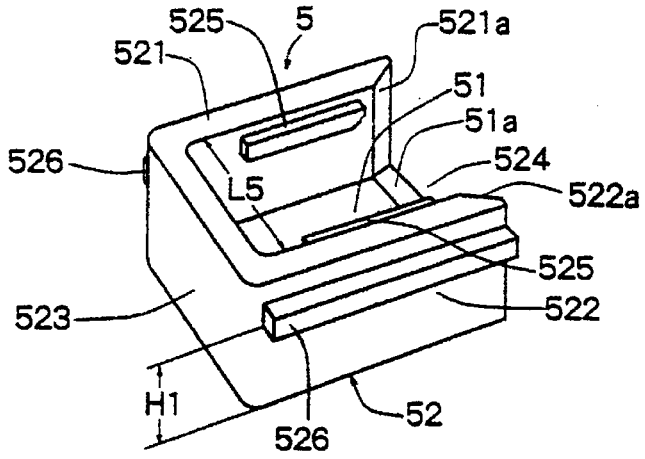
FIG. 3 is a perspective view showing an embodiment of a tentative cap constituting the developer replenishing apparatus of the present invention.
Figure 4:
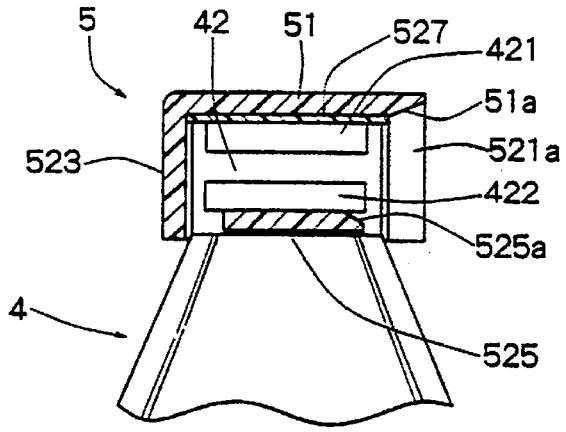
FIG. 4 is a sectional view showing a state in which the tentative cap of FIG. 3 is mounted on the adapter of FIG. 2.
Figure 5:
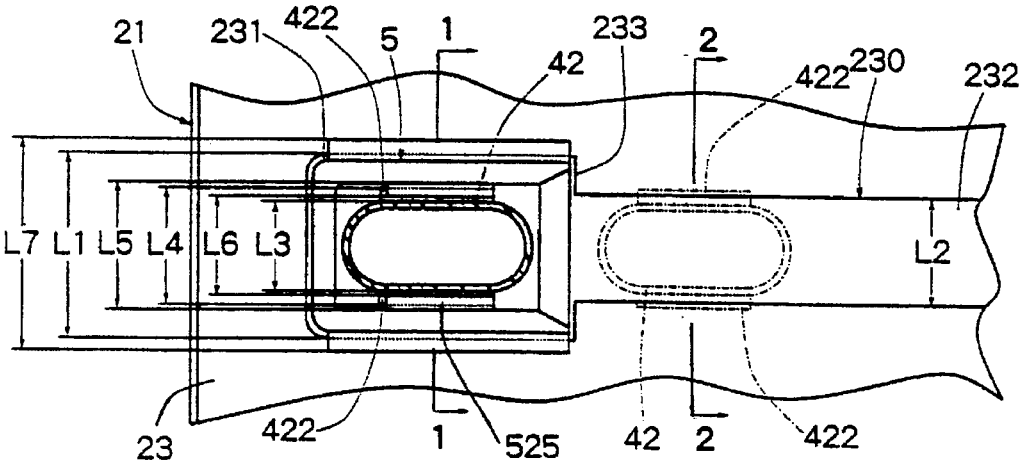
FIG. 5 is a plan view showing the positional relationship among a guide hole formed in a shielding plate of the developer housing shown in FIG. 1, the adapter, and the tentative cap.
Figure 6:
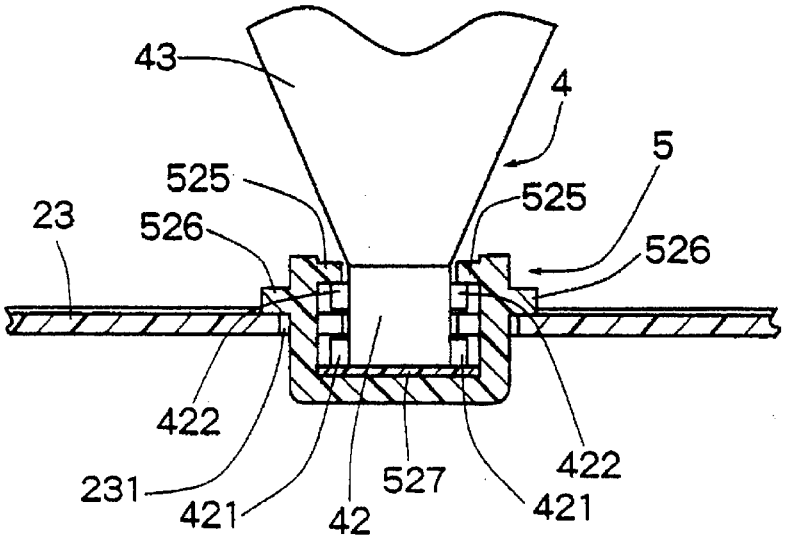
FIG. 6 is a sectional view taken on line A—A of FIG. 5.
Figure 7:
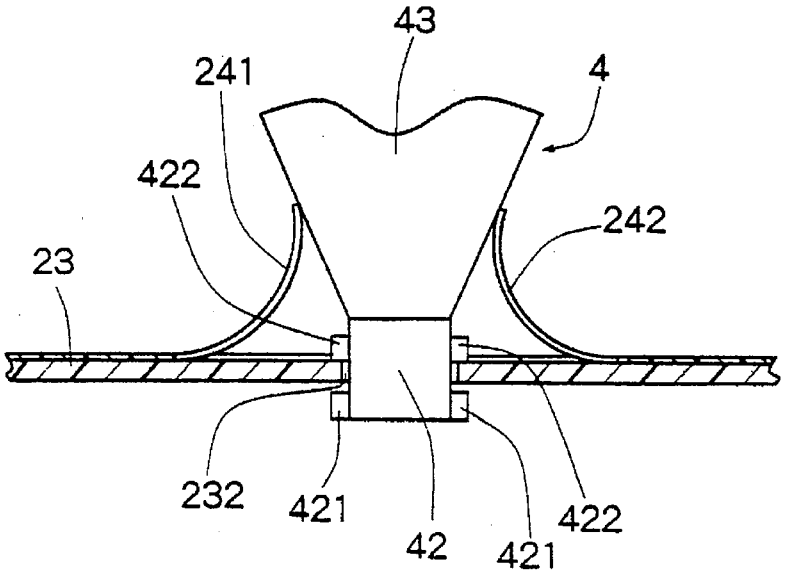
FIG. 7 is a sectional view taken on line B—B of FIG. 5.
Figure 8:
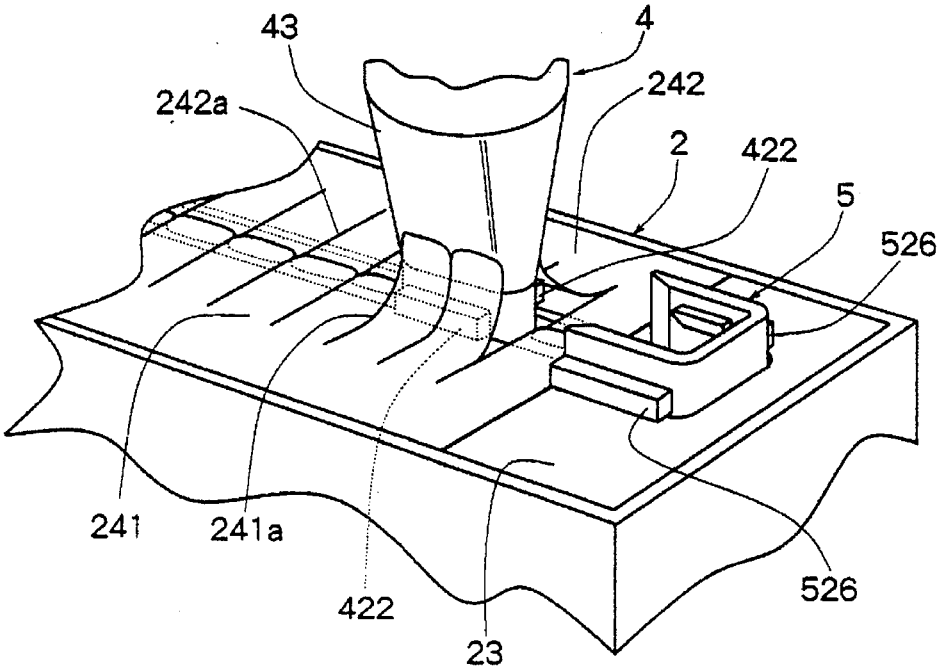
FIG. 8 is a perspective view showing the state of toner replenishment by a developer replenishing apparatus comprising the developer housing of FIG. 1, the replenishing developer container and adapter of FIG. 2, and the tentative cap of FIG. 3.

FIG. 1 to FIG. 8 illustrate an embodiment of a developer replenishing apparatus constructed in accordance with the present invention, in which FIG. 1 is a perspective view, partly broken away, of a developer housing constituting the developer replenishing apparatus; FIG. 2 is a perspective view of a replenishing developer container constituting the developer replenishing apparatus, and an adapter mounted on the replenishing developer container; FIG. 3 is a perspective view of a tentative cap constituting the developer replenishing apparatus; FIG. 4 is a sectional view showing a state in which the tentative cap of FIG. 3 is mounted on the adapter; FIG. 5 is a plan view showing the positional relationship among a guide hole formed in a shielding plate of the developer housing, the adapter, and the tentative cap; FIG. 6 is a sectional view taken on line A—A of FIG. 5; FIG. 7 is a sectional view taken on line B—B of FIG. 5; and FIG. 8 is a perspective view of the developer replenishing apparatus showing the state of toner replenishment. A developer housing 2 shown in FIG. 1 has an accommodating housing 21 formed of a plastic material, which is formed integrally with, or mounted on, a development housing of a developing device to be mounted on an image forming machine (not shown). At the lower end of the accommodating housing 21 is provided a toner feed port 211. Inside the accommodating housing 21 is disposed a toner feed roller 22 above the toner feed port 211. The toner feed roller 22 is driven by a suitable driving means (not shown), whereby a toner accommodated in the accommodating housing 21 is fed to a developing device (not shown).

On an opening at the upper end of the accommodating housing 21 is mounted a shielding plate 23 formed of a sheet metal. In the shielding plate 23 is formed a guide hole 230 caused to extend longitudinally of the accommodating housing 21. The guide hole 230 in the illustrated embodiment has a cap fitting portion 231 provided at an end portion of the shielding plate 23, and an adapter guide portion 232 formed so as to communicate with the cap fitting portion 231. The cap fitting portion 231 is formed so as to have a width dimension (L1) through which a tentative cap to be described later can be fitted. The adapter guide portion 232 is formed so as to have a width dimension (L2) which is smaller than the width of the cap fitting portion 231 and through which a toner outlet portion of an adapter to be described later can be inserted. On the upper surface of the shielding plate 23 is disposed a sealing means 24 covering the adapter guide portion 232 of the guide hole 230. The sealing means 24 is composed, in the illustrated embodiment, of two elastically flexible thin plastic sheets 241 and 242 such as polyethylene terephthalate (PETP) films. The two thin plastic sheets 241 and 242 are arranged side by side so that their inner edges facing each other along the adapter guide portion 232 are positioned on the adapter guide portion. Their outer edge portions are bonded to the shielding plate 23 by an adhesive or a double bond tape. In the illustrated embodiment, the mutually facing inner edge portions of the two thin plastic sheets 241 and 242 are provided with a plurality of slits 241*a* and 242*a*, which reach the edges, at equal intervals and at positions opposite to each other. The mutually facing inner edge portions of the two thin plastic sheets 241 and 242 are also adapted to overlap each other.

A replenishing developer container 3 shown in FIG. 2 is a toner bottle of a plastic material in customary use. Its mouth and neck portion 31 has an external thread, and is covered with a cap (not shown) when the container 3 is stored. For replenishment of a toner, an adapter 4 shown in FIG. 2 is mounted on the mouth and neck portion 31 of the replenishing developer container 3 after the cap mounted on the mouth and neck portion 31 is removed. The adapter 4 is integrally formed of a plastic material. It has a cylindrical end portion, and on its inside surface an internal thread to be screwed over the external thread formed on the mouth and neck portion 31, forming a mounting portion 41. The other end portion of the adapter 4 is formed in an elliptic cylindrical shape, forming a toner outlet portion 42. The toner outlet portion 42 and the mounting portion 41 are connected together by a connecting portion 43. The outside surface width (L3) of the toner outlet portion 42 is slightly smaller than the width (L2) of the adapter guide portion 232. On the outside surface of the toner outlet portion 42 are formed first flanges 421, 421 at opposite positions in the front end portion, and second flanges 422, 422 are formed at predetermined distances from the first flanges 421, 421. The distances between the first flanges 421, 421 and the second flanges 422, 422 formed in the up-and-down direction on the outside surface of the toner outlet portion 42 are larger than the thickness of the shielding plate 23. The outside surface width (L4) defined by the first flanges 421, 421 or the second flanges 422, 422 is greater than the width (L2) of the adapter guide portion 232.

A tentative cap 5 shown in FIG. 3 has a top panel wall 51, and a skirt wall 52 extending downwardly from the top panel wall 51, and is integrally molded from a plastic material. The skirt wall 52 is composed of opposite side walls 521, 522 and a rear wall 523, and has an opening 524 at its front part. The planar shape of the tentative cap 5 corresponds to the shape of the cap fitting portion 231 of the guide hole 230 provided in the shielding plate 23. The inside surface width (L5) defined by the opposite side walls 521, 522 constituting the skirt wall 52 is slightly larger than the outside surface width (L4) defined by the first flanges 421, 421 or the second flanges 422, 422 provided in the toner outlet portion 42 of the adapter 4. Side end portions, on the opening 524 side, of the top panel wall 51 and the opposite side walls 521, 522 constituting the skirt wall 52 are provided with an inclined guide surface 51*a*, and inclined guide surfaces 521*a*, 522*a*, respectively, each extending in an outwardly opening manner. On the inside surfaces at the center of front end portions of the opposite side walls 521, 522 of the skirt wall 52 are provided engaging protrusions 525, 525 engaging the second flanges 422, 422. The inside surface width (L6) defined by the engaging protrusions 525, 525 is slightly larger than the outside surface width (L3) of the toner outlet portion 42 of the adapter 4. On the top panel wall 51 side and the opening 524 side of the engaging protrusions 525, 525 are formed inclined guide surfaces 525*a*, 525*a*. The thus constructed tentative cap 5 is mounted on the toner outlet portion 42 of the adapter 4. In mounting the tentative cap 5 on the toner outlet portion 42, the tentative cap 5 is inverted from the state of FIG. 3, and slid and fitted on the toner outlet portion 42 of the adapter 4, beginning with the opening 524. On this occasion, the inclined guide surface 51*a* formed in the top panel wall 51, and the inclined guide surfaces 521*a*, 522*a* formed in the opposite side walls 521, 522 constituting the skirt wall 52 guide the slide. Whereas the inclined guide surfaces 525*a*, 525*a* formed in the engaging protrusions 525, 525 guide the engagement between the second flanges 422, 422 and the engaging protrusions 525, 525. In the state of FIG. 4 showing the tentative cap 5 mounted on the toner outlet portion 42, because of the engagement between the second flanges 422, 422 and the engaging protrusions 525, 525, a packing member 527, such as a sponge, mounted on the inner surface of the top panel wall 51 constituting the tentative cap 5 is pressed against the end surface of the toner outlet portion 42, thereby closing the outlet port 420 of the toner outlet portion 42. By the way, the tentative cap 5 has been mounted in advance on the toner outlet portion 42 of the adapter 4. On the outside surfaces of the front end portions of the opposite side walls 521, 522 of the skirt wall 52 are provided engaging protrusions 526, 526 as stoppers. The outside surface width (L7) defined by the engaging protrusions 526, 526 is larger than the width dimension (L1) of the cap fitting portion 231 of the guide hole 230 formed in the shielding plate 23. Thus, when the tentative cap 5 is fitted into the cap fitting portion 231 of the guide hole 230 with the top panel wall 51 lying downward, the engaging protrusions 526, 526 contact the upper surface of the shielding plate 23, restricting a downward fall. The height (H1) from the external surface of the top panel wall 51 to the contact surface of the engaging protrusions 526, 526 is set such that when the tentative cap 5 is mounted on the toner outlet portion 42 of the adapter 4 and fitted into the cap fitting portion 231 of the guide hole 230, the shielding plate 23 is positioned between the first flanges 421, 421 and the second flanges 422, 422 provided in the toner outlet portion 42 of the adapter 4.

The developer replenishing apparatus according to the embodiment illustrated in FIG. 1 to FIG. 8 is constructed in the above manner. Its actions will be described below. When the toner accommodated in the developer housing 21 has been consumed, and a replenishing toner is to be supplied to the developer housing 21, the cap mounted on the mouth and neck portion 31 of the replenishing developer container 3 is removed, whereafter the adapter 4 with the tentative cap 5 mounted beforehand is mounted on the mouth and neck portion 31. This mounting of the adapter 4 can be achieved by screwing the internal thread formed in the mounting portion 41 of the adapter 4 around the external thread formed on the mouth and neck portion 31 of the replenishing developer container 3. The replenishing developer container 3 with the adapter 4 so mounted is inverted, and the toner outlet portion 42 of the adapter 4 and the tentative cap 5 mounted on the toner outlet portion 42 are fitted from above into the cap fitting portion 231 of the guide hole 230 provided in the shielding plate 23 of the developer housing 2, as shown in FIG. 5. On this occasion, the fitting is performed with the opening 524 of the tentative cap 5 being placed on the adapter guide portion 232 side. This state is as shown in FIG. 6 as a sectional view taken on line A—A of FIG. 5. In such a state in which the toner outlet portion 42 of the adapter 4 and the tentative cap 5 are fitted into the cap fitting portion 231 of the guide hole 230 provided in the shielding plate 23, the engaging protrusions 526, 526 contact the upper surface of the shielding plate 23, and the skirt wall 52 of the tentative cap 5 is positioned so as to face the border of the shielding plate 23 defining the cap fitting portion 231. The site between the first flanges 421, 421 and the second flanges 422, 422 provided on the toner outlet portion 42 of the adapter 4 is positioned so as to face the shielding plate 23. When the replenishing developer container 3 and the adapter 4 are slid rightward from this state in FIG. 5, the tentative cap 5 is kept in contact with a shoulder portion 233 between the cap fitting portion 231 and the adapter guide portion 232, whereby its movement is restricted, so that the replenishing developer container 3 and the adapter 4 are moved rightward in FIG. 5. This situation produces a state in which a border portion of the shielding plate 23 defining the adapter guide portion 232 is sandwiched between the first flanges 421, 421 and the second flanges 422, 422 provided on the toner outlet portion 42 of the adapter 4. Thus, the replenishing developer container 3 and the adapter 4 are moved along the border defining the adapter guide portion 232 of the shielding plate 23 while their movement in the up-and-down direction is being restricted. At a position shown by one-dot chain lines in FIG. 5, the adapter 4 is released from the tentative cap 5. This state is as shown in FIG. 7 as a sectional view taken on line B—B of FIG. 5.

Once the adapter 4 leaves the tentative cap as shown above, the replenishing developer container 3 and the adapter 4 are moved along the adapter guide portion 232 of the guide hole 230 provided in the shielding plate 23, whereby the replenishing toner accommodated in the replenishing developer container 3 can be supplied to the developer housing 2 through the toner outlet port 420 formed at the front end of the toner outlet portion 42 of the adapter 4. During the movement of the replenishing developer container 3 and the adapter 4, the two thin plastic sheets 241 and 242 constituting the sealing means 24 covering the adapter guide portion 232 of the guide hole 230 provided in the shielding plate 23 become open while being pushed up by the toner outlet portion 42 of the adapter 4 moving in the adapter guide portion 232, as shown in FIG. 7 and FIG. 8. During this motion, inner end portions of the sheets 241 and 242 touch the connecting portion 43 of the adapter 4. In the illustrated embodiment, the inner edge portions of the two thin plastic sheets 241 and 242 are provided with the plurality of slits 241*a* and 242*a* reaching their ends. Thus, only that part between the adjacent slits where the adapter lies is elastically deformed and expanded. Whereas the other parts are restored to their original state, so that the opening can be minimized. Consequently, a scatter of the toner falling into the developer housing 2 and flying up can be kept to a minimum. Furthermore, the two thin sheets 241 and 242 constituting the sealing means 24 are composed of a plastic material and have a low coefficient of friction. Since frictional resistance during the movement of the replenishing developer container 3 and the adapter 4 is thus low, they can be moved smoothly.

When the replenishing toner accommodated in the replenishing developer container 3 has been discharged into the developer housing 2 as described above, the replenishing developer container 3 and the adapter 4 are moved leftward in FIG. 5, whereupon the tentative cap 5 fitted into the cap fitting portion 231 is mounted on the toner outlet portion 42 of the adapter 4. When the tentative cap 5 has been mounted on the toner outlet portion 42 of the adapter 4, the replenishing developer container 3 and the adapter 4 are withdrawn upward, completing the toner replenishing operation. As seen here, the replenishing developer container 3 and the adapter 4 can be brought upward of the shielding plate 23 only at the cap fitting portion 231 of the guide hole 230. When they are returned to the cap fitting portion 231, the tentative cap 5 is mounted on the toner outlet portion 42 of the adapter 4. Thus, even if the remaining toner exists in the replenishing developer container 3, there is no possibility for a flood of the remaining toner on the shielding plate 23. The cap fitting portion 231 constituting the guide hole 230 provided in the shielding plate 23 is not equipped with the sealing means. However, the tentative cap 5 is fitted there at the time of toner replenishment. Hence, the toner fallen into the developer housing 2 and whirled up during replenishment does not scatter through the cap fitting portion 231.

Figure 9:
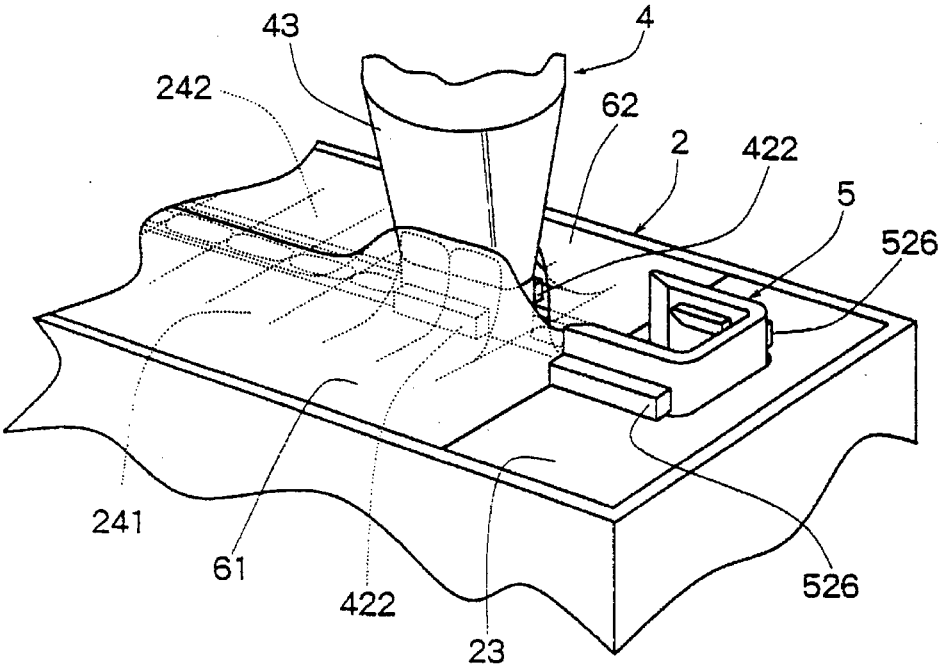
FIG. 9 is a perspective view showing the state of toner replenishment in accordance with another embodiment of the developer replenishing apparatus of the present invention.
Figure 10:
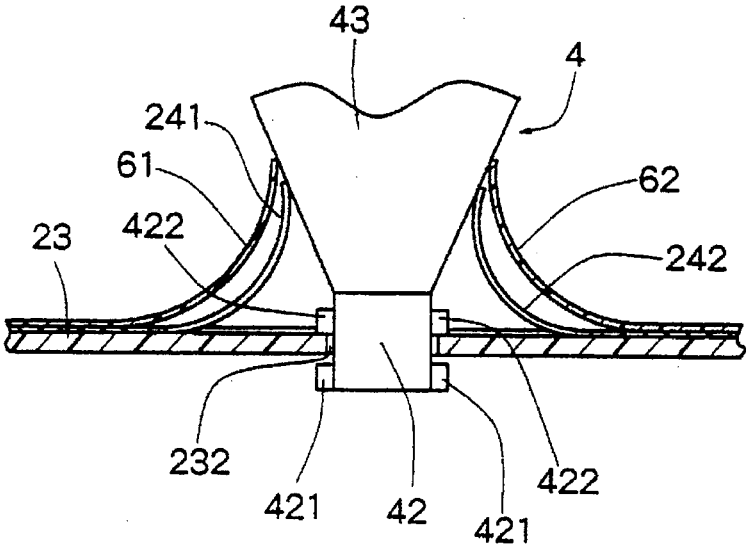
FIG. 10 is an essential part sectional view of the developer replenishing apparatus of FIG. 9.

FIG. 9 and FIG. 10 show another embodiment of the sealing means disposed in the developer housing 2 constituting the developer replenishing apparatus. According to this embodiment, two sealing members 61 and 62 comprising elastically flexible thin sheets are mounted above the thin plastic sheets 241 and 242 in the embodiment of FIG. 1 to FIG. 8. The sealing members 61 and 62 may each comprise a thin plastic sheet, such as a polyethylene terephthalate (PETP) film as in the case of the thin plastic sheets 241 and 242, or may comprise a rubber material. The sealing members 61 and 62 are formed so as to have nearly the same size as the thin plastic sheets 241 and 242, and their outer edge portions are bonded to the upper surfaces of the thin plastic sheets 241 and 242 by means of an adhesive or a double bond tape. The thin plastic sheets 241 and 242 have a plurality of slits 241*a* and 242*a*. The toner tends to adhere to their slit portions and their overlapping portions, and the adhered toner stains the hand and clothing of an operator replenishing the toner. In the instant embodiment, however, the sealing members 61 and 62 are disposed on the thin plastic sheets 241 and 242. Thus, the hand and clothing of the toner replenishing operator do not touch the toner adhering to the slits 241*a* and 242*a* formed in the thin plastic sheets 241 and 242, so that a toner stain can be prevented.

Figure 11:
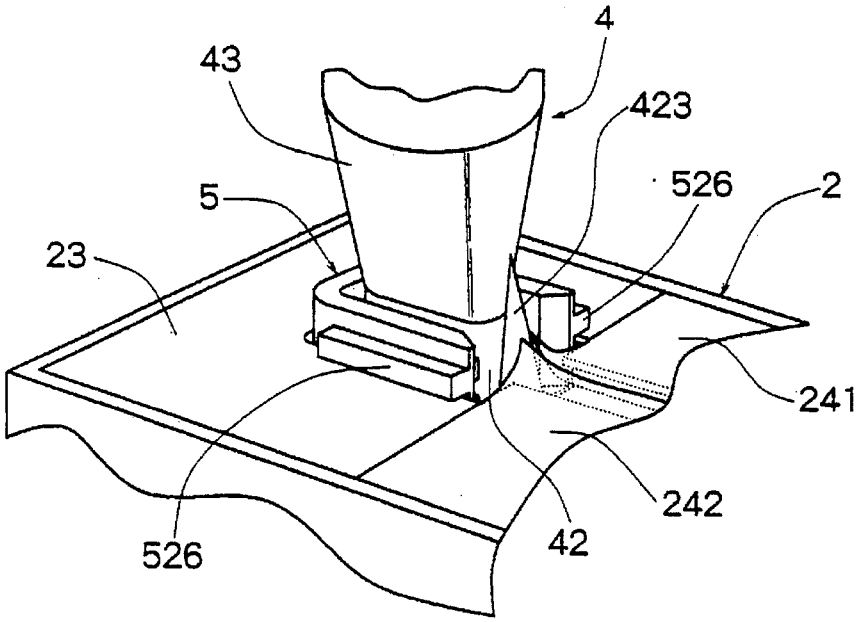
FIG. 11 is a perspective view showing the state of toner replenishment in accordance with still another embodiment of the developer replenishing apparatus of the present invention.
Figure 12:
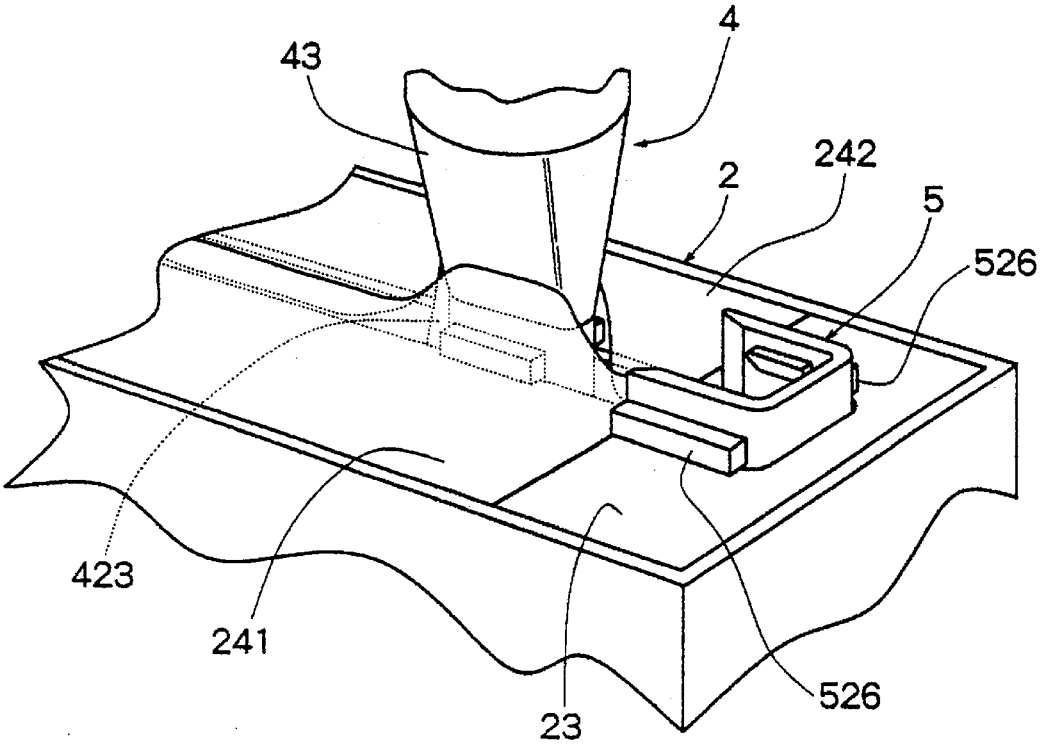
FIG. 12 is a perspective view showing the state of toner replenishment by the developer replenishing apparatus of FIG. 11.
Figure 13:
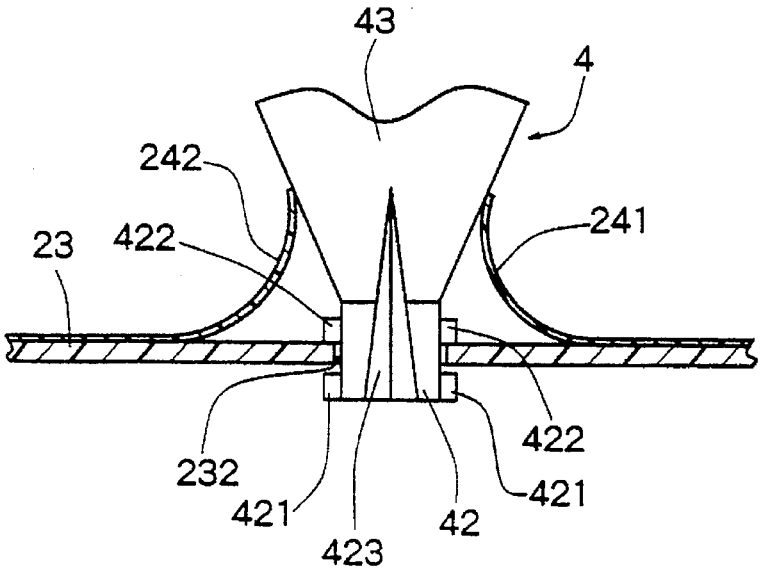
FIG. 13 is an essential part sectional view of the developer replenishing apparatus of FIG. 11.

FIG. 11 to FIG. 13 show another embodiment of the adapter 4 constituting the developer replenishing apparatus. In this embodiment, a guide protrusion 423 having inclined surfaces converging forward is provided on that end surface of the outlet portion 42 of the adapter 4 in each of the aforementioned embodiments which faces the opening 524 side, with the tentative cap 5 being mounted on the outlet portion 42. The instant embodiment also shows an example in which the two thin plastic sheets 241 and 242 constituting the sealing means 24 have no slits. As noted here, the adapter 4 in this embodiment has the guide protrusion 423 provided on that end surface of the outlet portion 42 which faces the opening 524 side, with the tentative cap 5 being mounted on the outlet portion 42. Thus, when the adapter 4 is moved to the adapter guide portion 232 from the position in the cap fitting portion 231 of the guide hole 230 formed in the shielding plate 23, the guide protrusion 423 can easily push through the two thin plastic sheets 241 and 242 constituting the sealing means 24, thus making the movement of the replenishing developer container 3 and the adapter 4 smooth.

As described above, the developer replenishing apparatus constructed according to the first aspect of the invention is constituted in the following manner: The adapter to be mounted on the mouth and neck portion of the replenishing developer container has the tentative cap mounted on its outlet portion. The replenishing developer container mounted with the adapter is put upside down. The toner outlet portion of the adapter, and the tentative cap mounted on the toner outlet portion are fitted from above into the cap fitting portion of the guide hole provided in the shielding plate of the developer housing. When the replenishing developer container and the adapter are slid from this state toward the adapter guide portion, the tentative cap contacts the shoulder portion between the cap fitting portion and the adapter guide portion, and has its movement restricted. When the replenishing developer container and the adapter are further moved, the adapter is released from the tentative cap. Thus, an overflow of the toner at the time of setting the replenishing developer container can be prevented. Moreover, the sealing means, which covers the adapter guide portion of the guide hole and is adapted to be elastically opened by the adapter moving along the adapter guide portion, is mounted on the upper surface of the shielding plate. Thus, a scatter of the toner from the adapter guide portion during toner replenishment can be prevented. The cap fitting portion constituting the guide hole provided in the shielding plate has no sealing means. However, the tentative cap is fitted there during toner replenishment, so that the toner falling into the developer housing and flying up during toner replenishment does not scatter through the cap fitting portion. In addition, when the replenishing developer container and the adapter are returned to the cap fitting portion at the completion of toner replenishment, the tentative cap is mounted on the toner outlet portion of the adapter. Thus, if the remaining toner exists in the replenishing developer container when the replenishing developer container and the adapter are withdrawn from the guide hole, there is no worry about the remaining toner overflowing onto the shielding plate.

Furthermore, the two thin sheets constituting the sealing means are composed of a plastic material and have a low coefficient of friction. Since frictional resistance during the movement of the replenishing developer container and the adapter is thus low, they can be moved smoothly. Moreover, the inner edge portions of the two thin plastic sheets are provided with a plurality of slits reaching their ends. Thus, only that part between the adjacent slits where the adapter lies is elastically deformed and expanded. Whereas the other parts are restored to their original state, so that the opening can be minimized. Consequently, a scatter of the toner falling into the developer housing and flying up can be kept to a minimum. In addition, the sealing means has the two sealing members, comprising elastically flexible thin sheets, disposed on the two thin plastic sheets having the plurality of slits. Thus, the hand and clothing of the toner replenishing operator do not touch the toner adhering to the slits formed in the thin plastic sheets, so that a toner stain can be prevented.

Additionally, the adapter has the first and second flanges formed at a predetermined distance in the up-and-down direction at opposite positions on the outside surface of the outlet portion. While the outlet portion is moving along the adapter guide portion of the guide hole, the borders of the shielding plate defining the adapter guide portion are interposed between the first and second flanges. When the toner is replenished, therefore, the replenishing developer container and the adapter cannot be brought upward of the shielding plate except at the cap fitting portion of the guide hole. This can reliably prevent a scatter of the toner from the replenishing developer container and the adapter guide hole during toner replenishment.

Also, the adapter has the guide protrusion on that end surface of the outlet portion which faces the opening side, with the tentative cap being mounted on the outlet portion. Thus, when the adapter is moved to the adapter guide portion from the position in the cap fitting portion of the guide hole formed in the shielding plate, the guide protrusion can easily push through the sealing means, thus smoothing the movement of the replenishing developer container and the adapter.

Next, another embodiment of the developer replenishing apparatus and the tentative cap for developer replenishment, constructed in accordance with the present invention, will be described by reference to FIG. 14 to FIG. 23. The same members as in the embodiments shown in FIG. 1 to FIG. 13 will be assigned the same numerals or symbols for explanation.

Figure 14:
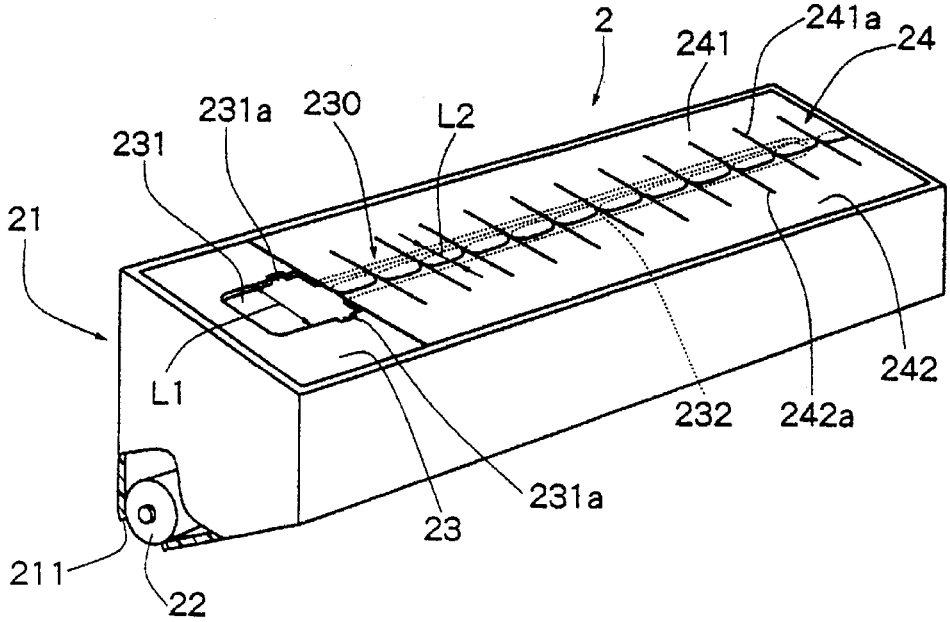
FIG. 14 is a perspective view, partly broken away, showing another embodiment of the developer housing constituting the developer replenishing apparatus of the present invention.

A developer housing 2 shown in FIG. 14 is different from the embodiment of FIG. 1 in terms of the structure of a guide hole 230 formed in a shielding plate 23 mounted on an upper end opening of an accommodating housing 21. That is, the opposite side edges of a cap fitting portion 231 constituting the guide hole 230 formed in the shielding plate 23 are provided with relief recesses 231*a*, 231*a* at positions deviating from their longitudinal center (deviating toward an adapter guide portion 232 in the illustrated embodiment). The other constituents of the developer housing 2 in this embodiment are substantially the same as in the embodiment of FIG. 1, and their details will be omitted.

Figure 15:
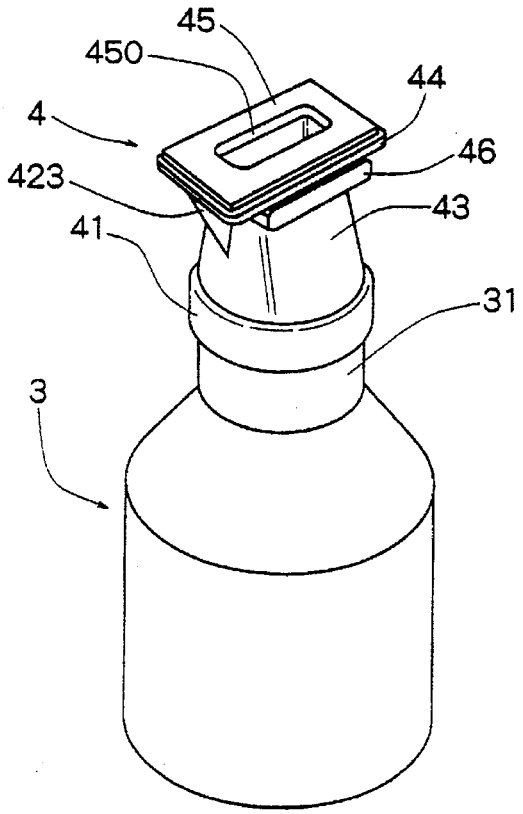
FIG. 15 is a perspective view showing another embodiment of the replenishing developer container constituting the developer replenishing apparatus of the present invention, and the adapter mounted on the replenishing developer container.
Figure 16:
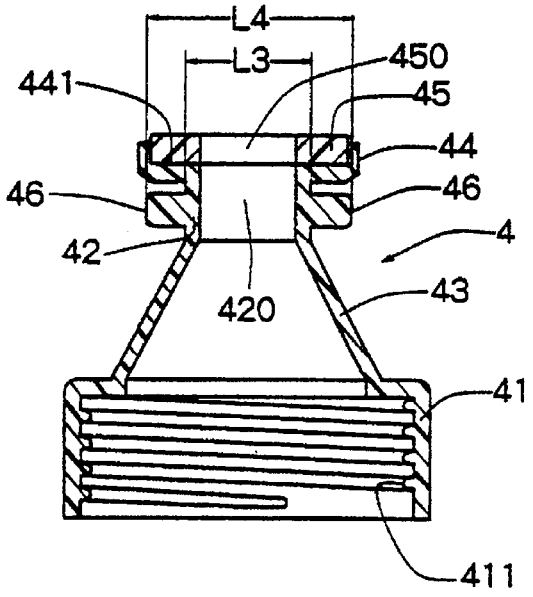
FIG. 16 is a sectional view of the adapter shown in FIG. 15.

FIG. 15 is a perspective view of a replenishing developer container constituting the developer replenishing apparatus, and an adapter mounted on the replenishing developer container. FIG. 16 is a sectional view of the adapter. A replenishing developer container 3 shown in FIG. 15 is substantially the same as in the embodiment of FIG. 2, and its explanation will be omitted. For replenishment of a toner, an adapter 4 shown in FIG. 15 and FIG. 16 is mounted on a mouth and neck portion 31 of the replenishing developer container 3 after the cap mounted on the mouth and neck portion 31 is removed. The adapter 4 is integrally formed of a plastic material. It has a cylindrical end portion, and on its inside surface an internal thread 411 to be screwed over the external thread formed on the mouth and neck portion 31, forming a mounting portion 41. The other end portion of the adapter 4 is formed in an elliptic cylindrical shape, forming a toner outlet portion 42. The toner outlet portion 42 and the mounting portion 41 are connected together by a connecting portion 43. The outside surface width (L3) of the toner outlet portion 42 is slightly smaller than the width (L2) of the adapter guide portion 232. At the other end of the adapter 4 is formed a rectangular first flange 44. On the end surface of the first flange 44 is formed a seal mounting portion 441. On the seal mounting portion 441 is mounted a sealing member 45 having a hole 450 corresponding to an outlet port 420 of the toner outlet portion 42. On the outside surface of the toner outlet portion 42 are formed second flanges 46, 46 at a predetermined distance from the first flange 44. The distance between the first flange 44 and the second flanges 46, 46 is larger than the thickness of the shielding plate 23. The outside surface width (L4) defined by the second flanges 46, 46 is greater than the width (L2) of the adapter guide portion 232. On the front end surface of the toner outlet portion 42 of the adapter 4 is provided a guide protrusion 423 having inclined surfaces converging forward.

Figure 17:
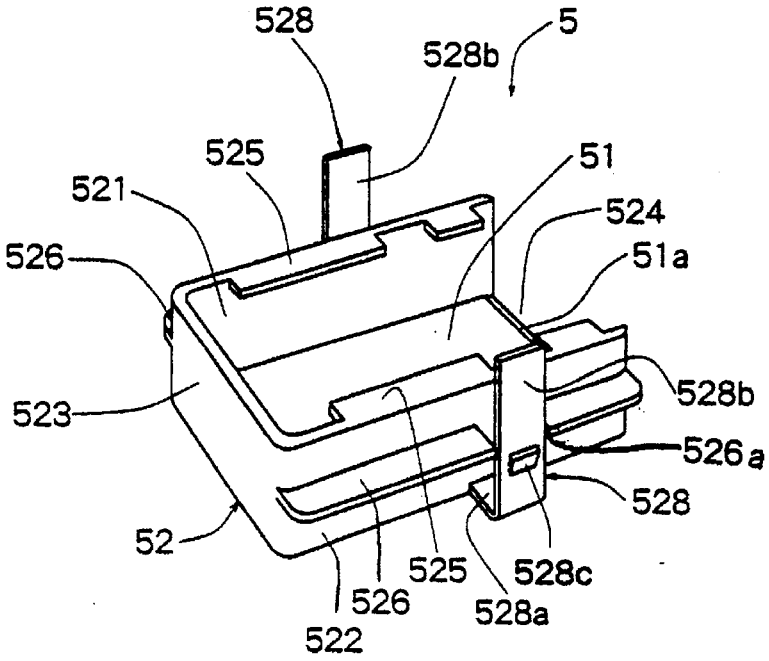
FIG. 17 is a perspective view showing another embodiment of the tentative cap constituting the developer replenishing apparatus of the present invention.
Figure 18:
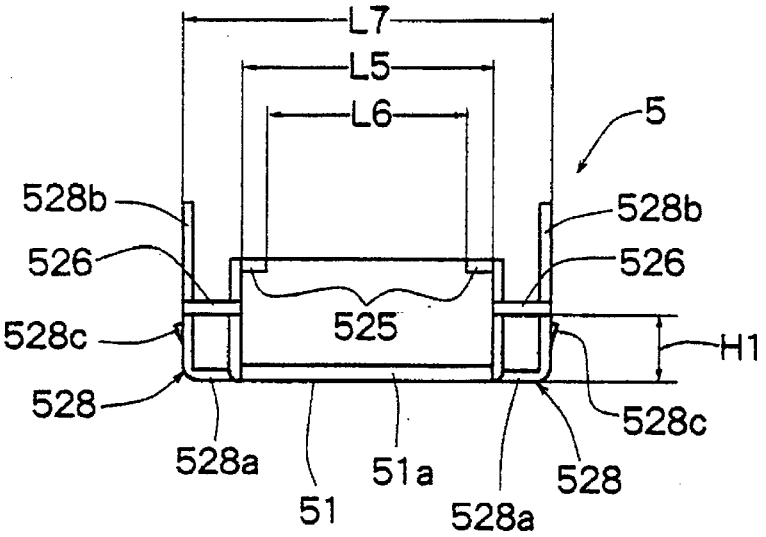
FIG. 18 is a side view of the tentative cap shown in FIG. 17.
Figure 19:
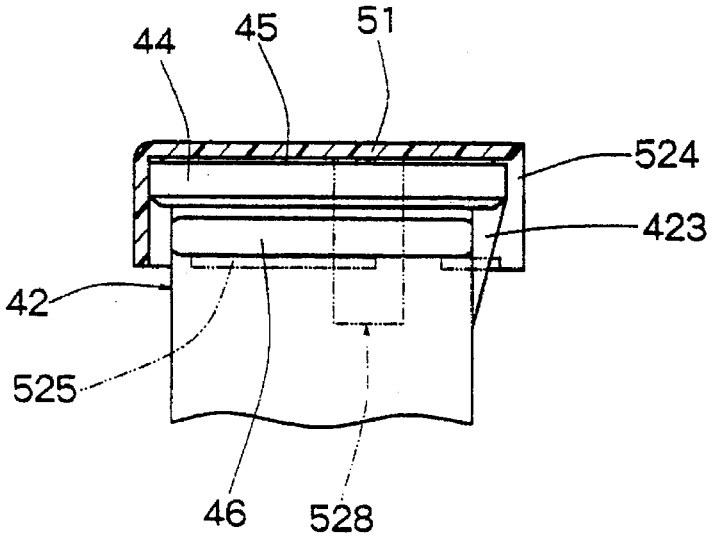
FIG. 19 is a sectional view showing a state in which the tentative cap of FIG. 17 is mounted on the adapter.
Figure 20:
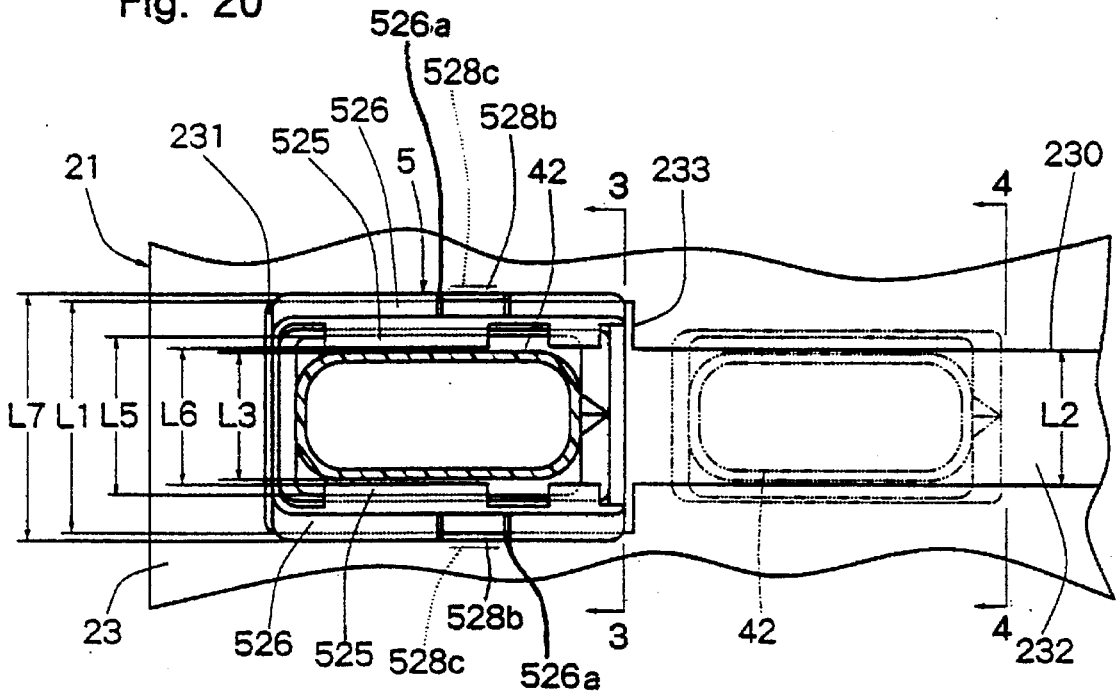
FIG. 20 is a plan view showing the positional relationship among the guide hole formed in the shielding plate of the developer housing, the adapter, and the tentative cap.

FIG. 17 is a perspective view of a tentative cap constituting the developer replenishing apparatus, FIG. 18 is a side view of the tentative cap, FIG. 19 is a sectional view showing a state in which the tentative cap of FIG. 17 and FIG. 18 is mounted on the adapter, and FIG. 20 is a plan view showing the positional relationship among a guide hole formed in a shielding plate of the developer housing, the adapter, and the tentative cap. A tentative cap 5 according to the illustrated embodiment has a top panel wall 51, and a skirt wall 52 extending downwardly from the top panel wall 51, and is integrally molded from a plastic material. The skirt wall 52 is composed of opposite side walls 521, 522 and a rear wall 523, and has an opening 524 at its front part. The planar shape of the tentative cap 5 corresponds to the shape of the cap fitting portion 231 of the guide hole 230 provided in the shielding plate 23. The inside surface width (L5) defined by the opposite side walls 521, 522 constituting the skirt wall 52 is slightly larger than the outside surface width (L4) defined by the second flanges 46, 46 provided in the toner outlet portion 42 of the adapter 4. An end portion, on the opening 524 side, of the top panel wall 51 is provided with an inclined guide surface 51*a* extending and opening outwardly. On the inside surfaces at the front end portions of the opposite side walls 521, 522 of the skirt wall 52 are provided engaging protrusions 525, 525 engaging the second flanges 46, 46. The width (L6) of the plane inside the engaging protrusions 525, 525 is slightly larger than the width (L3) of the outside surface of the toner outlet portion 42 of the adapter 4.

The thus constructed tentative cap 5 is mounted on the toner outlet portion 42 of the adapter 4. In mounting the tentative cap 5 on the toner outlet portion 42, the tentative cap 5 is inverted from the state of FIG. 17, and slid and fitted on the toner fitting portion 42 of the adapter 4, beginning with the opening 524. On this occasion, the inclined guide surface 51*a* formed on the top panel wall 51 guides the slide. In the state of FIG. 19 showing the tentative cap 5 mounted on the toner outlet portion 42, because of the engagement between the second flanges 46, 46 and the engaging protrusions 525, 525, the sealing member 45 mounted on the seal mounting portion 441 of the adapter 4 is pressed against the inner surface of the top panel wall 51 constituting the tentative cap 5, thereby closing the outlet port 420 of the toner outlet portion 42. By the way, the tentative cap 5 has been mounted on the toner outlet portion 42 of the adapter 4 in advance. On the outside surfaces of the opposite side walls 521, 522 constituting the skirt wall 52 are provided engaging protrusions 526, 526 as engaging projections constituting an engaging means. The outside surface width (L7) defined by the engaging protrusions 526, 526 is larger than the width dimension (L1) of the cap fitting portion 231 of the guide hole 230 formed in the shielding plate 23. Thus, when the tentative cap 5 is fitted into the cap fitting portion 231 of the guide hole 230 with the top panel wall 51 facing downward, the engaging protrusions 526, 526 engage the upper surface of the shielding plate 23, restricting a downward fall. The height (H1) from the external surface of the top panel wall 51 to the contact surface of the engaging protrusions 526, 526 is set such that when the tentative cap 5 is mounted on the toner outlet portion 42 of the adapter 4 and fitted into the cap fitting portion 231 of the guide hole 230, the shielding plate 23 is positioned between the first flange 44 and the second flanges 46, 46 provided in the toner outlet portion 42 of the adapter 4.

In the illustrated embodiment, the engaging protrusions 526, 526 have cutouts 526*a*, 526*a* deviating from their center toward the opening 524. At positions deviating from the longitudinal center of the opposite side walls 521, 522 of the skirt wall 52 toward the opening 524, namely, at positions corresponding to the cutouts 526*a*, 526*a* provided in the engaging protrusions 526, 526, are integrally molded engaging tongue pieces 528, 528 constituting the engaging means. An end of each of the engaging tongue pieces 528, 528 is connected to the opposite side walls 521, 522 of the skirt wall 52 beside the top panel wall 51. The engaging tongue pieces 528, 528 comprise horizontal portions 528*a*, 528*a* extending outwardly from the opposite side walls 521, 522 of the skirt wall 52, and grip portions 528*b*, 528*b* bent nearly perpendicularly from the horizontal portions 528*a*, 528*a* and extending nearly parallel to the opposite side walls 521, 522. The other ends of the grip portions 528*b*, 528*b* extend beyond the front end of the skirt wall 52. As seen here, the engaging tongue pieces 528, 528 has one end bonded to the opposite side walls 521, 522 of the skirt wall 52 and has the other end as a free end, so that they can be elastically bent in the right-and-left direction in FIG. 5. The external surfaces of the grip portions 528*b*, 528*b* constituting the engaging tongue pieces 528, 528 are coplanar with the outer end surfaces of the engaging protrusions 526, 526. The outer surfaces of the grip portions 528*b*, 528*b* constituting the engaging tongue pieces 528, 528 are provided with engaging claws 528*c*, 528*c*. These engaging claws 528*c*, 528*c* are provided closer to the top panel wall 51 than are the engaging protrusions 526, 526. The distance between the engaging claws 528*c*, 528*c* and the engaging protrusions 526, 526 is slightly greater than the thickness of the shielding plate 23.

Figure 21:
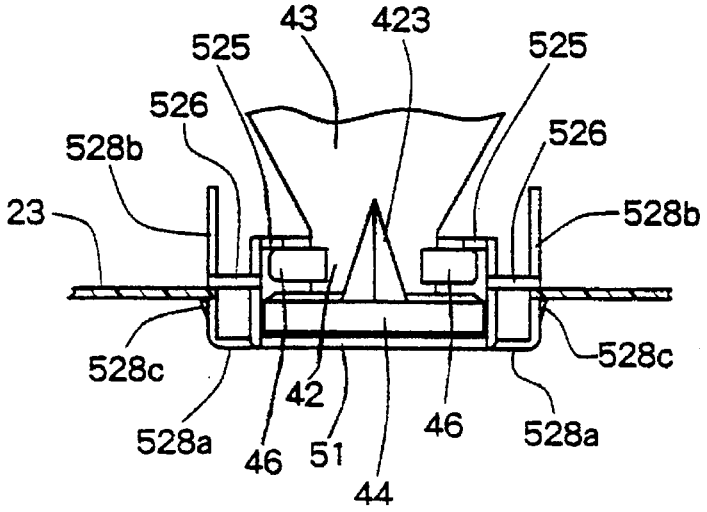
FIG. 21 is a sectional view taken on line C—C of FIG. 20.

The developer replenishing apparatus according to the illustrated embodiment is constructed in the above manner. Its actions will be described by reference to FIG. 21 to FIG. 23 as well. When the toner accommodated in the developer housing 21 has been consumed, and a replenishing toner is to be supplied to the developer housing 21, the cap mounted on the mouth and neck portion 31 of the replenishing developer container 3 is removed, whereafter the adapter 4 with the tentative cap 5 mounted beforehand is mounted on the mouth and neck portion 31. This mounting of the adapter 4 can be achieved by screwing the internal thread formed in the mounting portion 41 of the adapter 4 around the external thread formed on the mouth and neck portion 31 of the replenishing developer container 3. The replenishing developer container 3 with the adapter 4 so mounted is inverted, and the toner outlet portion 42 of the adapter 4 and the tentative cap 5 mounted on the toner outlet portion 42 are fitted from above into the cap fitting portion 231 of the guide hole 230 provided in the shielding plate 23 of the developer housing 2, as shown in FIG. 20. On this occasion, the fitting is performed with the opening 524 of the tentative cap 5 being placed on the adapter guide portion 232 side. In the illustrated embodiment, the opposite side edges of the cap fitting portion 231 formed in the shielding plate 23 are provided with the relief recesses 231*a*, 231*a* at positions deviating from their center toward the adapter guide portion 232. On the other hand, the engaging tongue pieces 528, 528 provided in the tentative cap 5 are formed on the opening 524 side relative to the center. Unless the engaging tongue pieces 528, 528 are aligned with the relief recesses 231*a*, 231*a*, the engaging tongue pieces 528, 528 will interfere with the opposite side edges of the cap fitting portion 231, making the fitting of the tentative cap 5 impossible. Thus, in mounting the tentative cap 5 into the cap fitting portion 231, the engaging tongue pieces 528, 528 are aligned with the relief recesses 231*a*, 231*a*, whereby the right positional relationship for mounting is ensured. At the time of fitting the tentative cap 5, the grip portions 528*b*, 528*b* are bent inwards, as the engaging claws 528*c*, 528*c* provided on the grip portions 528*b*, 528*b* constituting the engaging tongue pieces 528, 528 pass the borders of the relief recesses 231*a*, 231*a* formed in the cap fitting portion 231. To make smoother the passage of the engaging claws 528*c*, 528*c* provided on the grip portions 528*b*, 528*b*, it suffices to fit the tentative cap 5 while bending front end portions of the grip portions 528*b*, 528*b* inwardly by the fingers. This state is as shown in FIG. 21 as a sectional view taken on line C—C of FIG. 20.

Figure 22:
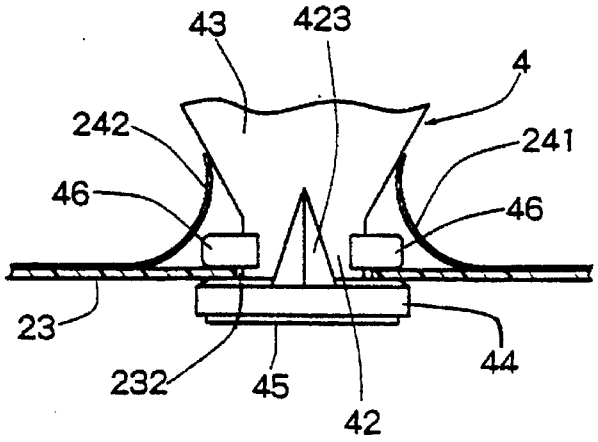
FIG. 22 is a sectional view taken on line D—D of FIG. 20.

In such a state in which the toner outlet portion 42 of the adapter 4 and the tentative cap 5 are fitted into the cap fitting portion 231 of the guide hole 230 provided in the shielding plate 23, the engaging protrusions 526, 526 engage the upper surface of the shielding plate 23, while the engaging claws 528*c*, 528*c* engage the lower surface of the shielding plate 23, whereby the upward and downward movement of the tentative cap 5 is restricted. The site between the first flange 44 and the second flanges 46, 46 provided on the toner outlet portion 42 of the adapter 4 is positioned so as to face the shielding plate 23. When the replenishing developer container 3 and the adapter 4 are slid rightward from this state in FIG. 20, the tentative cap 5 is kept in contact with a shoulder portion 233 between the cap fitting portion 231 and the adapter guide portion 232, whereby its movement is restricted, so that the replenishing developer container 3 and the adapter 4 are moved rightward in FIG. 20. This situation produces a state in which a border portion of the shielding plate 23 defining the adapter guide portion 232 is sandwiched between the first flange 44 and the second flanges 46, 46 provided on the toner outlet portion 42 of the adapter 4. Thus, the replenishing developer container 3 and the adapter 4 are moved along the border of the shielding plate 23 defining the adapter guide portion 232 while their movement in the up-and-down direction is being restricted. At a position shown by two-dot chain lines in FIG. 20, the adapter 4 is released from the tentative cap 5. This state is as shown in FIG. 22 as a sectional view taken on line D—D of FIG. 7.

Figure 23:
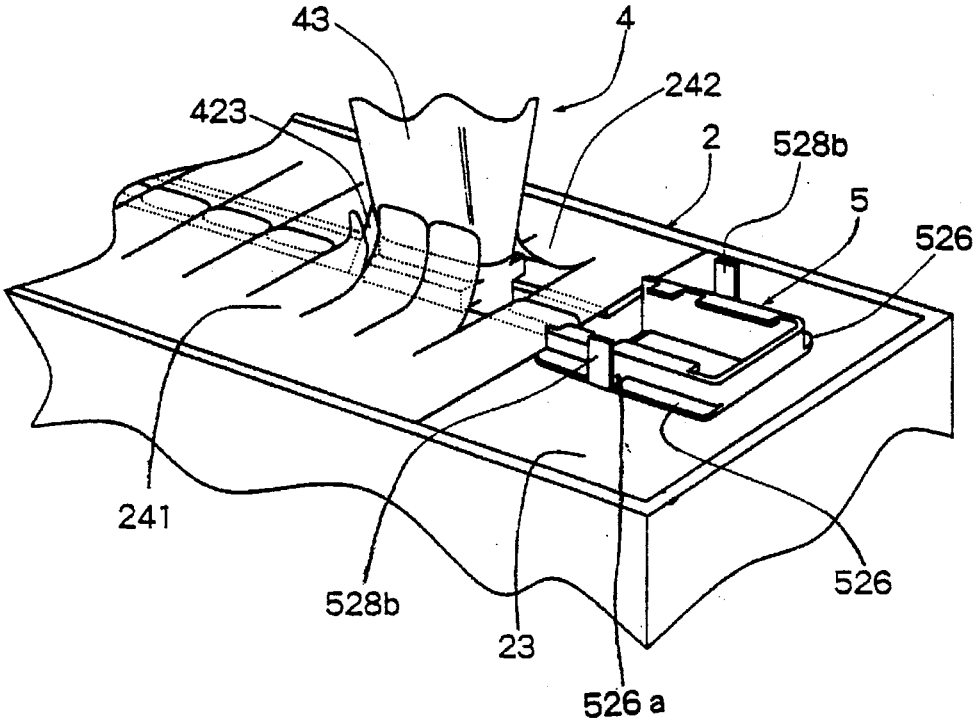
FIG. 23 is a perspective view showing the state of toner replenishment by the developer replenishing apparatus comprising the developer housing, the replenishing developer container, the adapter, and the tentative cap.

Once the adapter 4 leaves the tentative cap 5 as shown above, the replenishing developer container 3 and the adapter 4 are moved along the adapter guide portion 232 of the guide hole 230 provided in the shielding plate 23, whereby the replenishing toner accommodated in the replenishing developer container 3 can be supplied to the developer housing 2 through the toner outlet port 420 formed at the front end of the toner outlet portion 42 of the adapter 4. During the movement of the replenishing developer container 3 and the adapter 4, the two thin plastic sheets 241 and 242 constituting the sealing means 24 covering the adapter guide portion 232 of the guide hole 230 provided in the shielding plate 23 become open while being pushed up by the toner outlet portion 42 of the adapter 4 moving in the adapter guide portion 232, as shown in FIG. 22 and FIG. 23. During this motion, inner end portions of the sheets 241 and 242 touch the connecting portion 43 of the adapter 4. When the two thin plastic sheets 241 and 242 constituting the sealing means 24 are opened while being pushed up by the adapter 4, a guide protrusion 423 formed at the end surface of the outlet portion 42 of the adapter 4 enables the thin plastic sheets 241 and 242 to be easily pushed open. Thus, the movement of the replenishing developer container 3 and the adapter 4 can be smoothed. In the illustrated embodiment, the inner edge portions of the two thin plastic sheets 241 and 242 are provided with a plurality of slits 241*a* and 242*a* reaching their ends. Thus, only that part between the adjacent slits where the adapter 4 lies is elastically deformed and expanded. Whereas the other parts are restored to their original state, so that the opening can be minimized. Consequently, a scatter of the toner falling into the developer housing 2 and flying up can be kept to a minimum. Furthermore, the two thin sheets 241 and 242 constituting the sealing means 24 are composed of a plastic material and have a low coefficient of friction. Since frictional resistance during the movement of the replenishing developer container 3 and the adapter 4 is thus low, they can be moved smoothly.

When the replenishing toner accommodated in the replenishing developer container 3 has been discharged into the developer housing 2 as described above, the replenishing developer container 3 and the adapter 4 are moved leftward in FIG. 20, whereupon the tentative cap 5 fitted into the cap fitting portion 231 is mounted on the toner outlet portion 42 of the adapter 4. When the tentative cap 5 has been mounted again on the toner outlet portion 42 of the adapter 4, the grip portions 528*b*, 528*b* constituting the engaging tongue pieces 528, 528 are bent inwards by the fingers, and the engaging claws 528*c*, 528*c* are positioned inwardly of the borders of the relief recesses 231*a*, 231*a*. At the same time, the replenishing developer container 3 and the adapter 4 are withdrawn upward, completing the toner replenishing operation. As seen here, the replenishing developer container 3 and the adapter 4 can be brought upward of the shielding plate 23 only at the cap fitting portion 231 of the guide hole 230. When they are returned to the cap fitting portion 231, the tentative cap 5 is mounted on the toner outlet portion 42 of the adapter 4. Thus, even if the remaining toner exists in the replenishing developer container 3, there is no possibility for a flood of the remaining toner on the shielding plate 23. The cap fitting portion 231 constituting the guide hole 230 provided in the shielding plate 23 is not equipped with the sealing means. However, the tentative cap 5 is fitted there at the time of toner replenishment. Hence, the toner fallen into the developer housing 2 and whirled up during toner replenishment does not scatter through the cap fitting portion 231.

As described above, the developer replenishing apparatus constructed according to the second aspect of the invention is constituted in the following manner: The adapter mounted on the mouth and neck portion of the replenishing developer container has the tentative cap mounted on its outlet portion. The replenishing developer container mounted with the adapter is put upside down. The toner outlet portion of the adapter, and the tentative cap mounted on the toner outlet portion are fitted from above into the cap fitting portion of the guide hole provided in the shielding plate of the developer housing. When the replenishing developer container and the adapter are slid from this state toward the adapter guide portion, the tentative cap contacts the shoulder portion between the cap fitting portion and the adapter guide portion, and has its movement restricted. When the replenishing developer container and the adapter are further moved, the adapter is released from the tentative cap. Thus, an overflow of the toner at the time of setting the replenishing developer container can be prevented. Furthermore, the tentative cap is provided with the engaging means engaging the cap fitting portion at a predetermined position, with the tentative cap being fitted into the cap fitting portion. The engaging means restricts the upward and downward movement of the tentative cap. Thus, there is no possibility that the tentative cap will be displaced in the up-and-down direction at the time of releasing and mounting the adapter, impairing its operating properties.

The engaging tongue pieces of the engaging means are formed at positions deviating sideways from the longitudinal center of the opposite side walls of the skirt wall constituting the tentative cap. Whereas the opposite side edges of the cap fitting portion constituting the guide hole are provided with the relief recesses, corresponding to the engaging tongue pieces, at positions deviating from their longitudinal center. Unless the engaging tongue pieces are aligned with the relief recesses when mounting the tentative cap on the cap fitting portion, the engaging tongue pieces will interfere with the opposite side edges of the cap fitting portion, making the fitting of the tentative cap impossible. Thus, in mounting the tentative cap into the cap fitting portion, the engaging tongue pieces are aligned with the relief recesses, whereby the right positional relationship for mounting is ensured.

The tentative cap for developer replenishment according to the third aspect of the invention has the engaging means on the opposite side walls of the skirt wall, the engaging means engaging, at predetermined positions, the cap fitting portion formed at an end portion of the shielding plate covering the upper part of the developer housing, when the tentative cap is fitted into the cap fitting portion, and the engaging means comprising the engaging protrusions provided on the opposite side walls of the skirt wall and engaging the upper surface of the shielding plate defining the cap fitting portion, and the flexible engaging tongue pieces connected at an end to the top panel wall side of the opposite side walls of the skirt wall and extending downwardly along the skirt wall, and the engaging tongue pieces are provided with the engaging claws engaging the lower surface of the shielding plate defining the cap fitting portion. Since the upward and downward movement of the tentative cap is restricted by the engaging means, there is no possibility that the tentative cap will be displaced in the up-and-down direction at the time of releasing and mounting the adapter, impairing its operating properties.

What we claim is:

1. A developer replenishing apparatus comprising a developer housing for accommodating a developer to be fed to a developing device, a replenishing developer container accommodating a developer for replenishment into the developer housing, an adapter having a mounting portion to be mounted detachably on a mouth and neck portion of the replenishing developer container and an outlet portion formed as an attachment to the mounting portion and having an outlet port for releasing the developer, and a tentative cap mounted detachably on the outlet portion of the adapter and closing the outlet port, wherein the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, the developer housing has a shielding plate covering its upper part, the shielding plate is provided with a guide hole including a cap fitting portion formed at an end portion of the shielding plate and being to be fitted with the tentative cap, and including an adapter guide portion formed so as to communicate with the cap fitting portion and having a width dimension which is smaller than the external surface width of the tentative cap and through which the outlet portion of the adapter can be inserted, and a sealing means adapted to cover the adapter guide portion of the guide hole and be caused to elastically open by the adapter moving along the adapter guide portion is mounted on the upper surface of the shielding plate.

2. The developer replenishing apparatus of claim 1 wherein the sealing means comprises two elastically flexible thin plastic sheets, the two thin plastic sheets are disposed side by side so that their inner edges facing each other are positioned on the adapter guide portion, and the two thin plastic sheets have outer edge portions bonded to the shielding plate.

3. The developer replenishing apparatus of claim 2 wherein the two thin plastic sheets constituting the sealing means have, at their inner edge portions facing each other, a plurality of slits reaching their ends.

4. The developer replenishing apparatus of claim 3 wherein the sealing means has two sealing members, comprising elastically flexible thin sheet materials, disposed on the upper surfaces of the two thin plastic sheets.

5. The developer replenishing apparatus of claim 1 wherein the adapter has first and second flanges formed at a predetermined distance in the up-and-down direction at opposite positions on the outside surface of the outlet portion; and while the outlet portion is moving along the adapter guide portion of the guide hole, the borders of the shielding plate defining the adapter guide portion are interposed between the first and second flanges.

6. The developer replenishing apparatus of claim 1 wherein the adapter has a guide protrusion on that end surface of the outlet portion which faces the opening side, with the tentative cap being mounted on the outlet portion.

7. A developer replenishing apparatus comprising a developer housing for accommodating a developer to be fed to a developing device, a replenishing developer container accommodating a developer for replenishment into the developer housing, an adapter having a mounting portion to be mounted detachably on a mouth and neck portion of the replenishing developer container and an outlet portion formed as an attachment to the mounting portion and having an outlet port for releasing the developer, and a tentative cap mounted detachably on the outlet portion of the adapter and closing the outlet port, wherein the developer housing has a shielding plate covering its upper part, the shielding plate is provided with a guide hole including a cap fitting portion formed at an end portion of the shielding plate and being to be fitted with the tentative cap, and including an adapter guide portion formed so as to communicate with the cap fitting portion, and having a width dimension which is smaller than the width of the cap fitting portion and through which the outlet portion of the adapter can be inserted, the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, and engaging means for engaging the cap fitting portion at predetermined positions, with the tentative cap being fitted into the cap fitting portion, are provided on the opposite side walls of the skirt wall, and the engaging means comprise engaging protrusions provided on the opposite side walls of the skirt wall and engaging the upper surface of the shielding plate defining the cap fitting portion, and flexible engaging tongue pieces connected at an end to the top panel wall side of the opposite side walls of the skirt wall and extending downwardly along the skirt wall, and the engaging tongue pieces are provided with engaging claws engaging the lower surface of the shielding plate defining the cap fitting portion.

8. The developer replenishing apparatus of claim 7 wherein the engaging tongue pieces of the engaging means are formed at positions deviating sideways from the longitudinal center of the opposite side walls of the skirt wall constituting the tentative cap, and the opposite side edges of the cap fitting portion constituting the guide hole are provided with relief recesses, corresponding to the engaging tongue pieces, at positions deviating from their longitudinal center.

9. A tentative cap for replenishment of a developer, which is mounted detachably on an outlet portion of an adapter to be mounted detachably on a mouth and neck portion of a replenishing developer container accommodating a developer for replenishment into a developer housing, wherein the tentative cap has a top panel wall and a skirt wall formed so as to extend downwardly from the outer peripheral edge of the top panel wall, the skirt wall is composed of opposite side walls and a rear wall, and has at its front part an opening through which the outlet portion of the adapter can be inserted, and engaging means for engaging a cap fitting portion at predetermined positions, with the tentative cap being fitted into the cap fitting portion, are provided on the opposite side walls of the skirt wall, the cap fitting portion being formed at an end portion of a shielding plate covering the upper part of the developer housing, and the engaging means comprise engaging protrusions provided on the opposite side walls of the skirt wall and engaging the upper surface of the shielding plate defining the cap fitting portion, and flexible engaging tongue pieces connected at an end to the top panel wall side of the opposite side walls of the skirt wall and extending downwardly along the skirt wall, and the engaging tongue pieces are provided with engaging claws engaging the lower surface of the shielding plate defining the cap fitting portion.

* * * * *